US005431494A

United States Patent [19]

Ishii et al.

[11] Patent Number: 5,431,494

[45] Date of Patent: Jul. 11, 1995

[54] SUCTION AND DILUTION DEVICE FOR HIGHLY VISCOUS FLUID

[75] Inventors: Katuharu Ishii, Atsugi; Shogo Nomura; Takeharu Seki, both of Sagamihara; Kenichi Hashimoto, Machida; Sohsuke Watabe, Sagamihara, all of Japan

[73] Assignee: The Calpis Food Industry Co., Ltd., Tokyo, Japan

[21] Appl. No.: 265,410

[22] Filed: Jun. 24, 1994

[30] Foreign Application Priority Data

Jul. 14, 1993 [JP] Japan ..... 5-174475
Dec. 28, 1993 [JP] Japan ..... 5-338527

[51] Int. Cl.[6] ..... B01F 15/02

[52] U.S. Cl. ..... 366/167.1; 366/191; 366/339

[58] Field of Search ..... 366/184, 191, 139, 150, 366/154, 155, 167, 168, 169, 172, 173, 336, 178

[56] References Cited

U.S. PATENT DOCUMENTS

| | | | |
|---|---|---|---|
| 1,668,136 | 5/1928 | Agthe | 366/167 |
| 4,549,813 | 10/1985 | Volz | 366/167 |
| 4,753,535 | 6/1988 | King | 366/167 |
| 4,783,319 | 11/1988 | Habrich | 366/174 |

*Primary Examiner*—Robert W. Jenkins
*Attorney, Agent, or Firm*—Darby & Darby

[57] ABSTRACT

A device for sucking and diluting a highly viscous fluid contains an outer tubular member having a suction port for sucking the highly viscous fluid therein, the outer tubular member being connected to a suction source, an inner tubular member arranged within the outer tubular member and adapted for passing a diluting luquid for diluting the highly viscous fluid therethrough, the inner tubular member having an ejection port for ejecting the diluting luquid into a space delimited between the outer tubular member and the inner tubular member, and a mixing device for uniformly mixing the highly viscous fluid and the diluting liquid in the space delimited between the outer tubular member and the inner tubular member.

8 Claims, 2 Drawing Sheets

SUCTION AND DILUTION DEVICE FOR HIGHLY VISCOUS FLUID

BACKGROUND OF THE INVENTION

This invention relates to a fluid suction device and, more particularly, to a suction and dilution device for a highly viscous fluid which sucks the highly viscous fluid as it dilutes the fluid.

Heretofore, highly viscous liquids, such as concentrated fruit juice, honey, various saccharide syrups, including high fructose corn syrup, condensed milk or the like, are diluted and subsequently charged into a desired vessel. However, an apparatus has been hitherto unknown which is capable of sucking the highly viscous liquid while simultaneously diluting it.

Such apparatus, however, has been a desideratum in manufactures employing the highly viscous liquid as a starting material. For example, in beverage manufactures employing concentrated fruit juices as a starting material, the concentrated fruit juices are diluted and mixed by manual operation so that the resulting mixture can be sucked by a liquid suction unit followed by performing the next suction step. Specifically, the concentrated fruit juice contained in a suitable vessel, such as a drum can, is sufficiently agitated and mixed together, as water is added thereto, and the resulting diluted fruit juice is sucked by a liquid suction unit, such as a rotary pump, in order to provide an ultimate product. The manual operation for the dilution process for such fruit juice is time- and labor-consuming with the consequence that the operating efficiency is lowered further.

SUMMARY OF THE INVENTION

It is an object of the present invention to provide a suction and dilution device for a highly viscous fluid which is capable of sucking the highly viscous fluid as it dilutes the fluid simultaneously.

The above and other objects of the present invention will become apparent from the following description.

According to the present invention, there is provided a device for sucking and diluting a highly viscous fluid comprising an outer tubular member having a suction port connected to a suction source for sucking the viscous fluid therein, and an inner tubular member arranged within the outer tubular member and adapted for passing a diluting liquid for diluting the highly viscous fluid therethrough. The inner tubular member has an ejection port for ejecting the diluting liquid into a space delimited between the outer tubular member and the inner tubular member. The device also includes mixing means for uniformly mixing the highly viscous fluid and the diluting liquid in the space delimited between the outer tubular member and the inner tubular member.

PREFERRED EMBODIMENTS OF THE INVENTION

Figure 2:
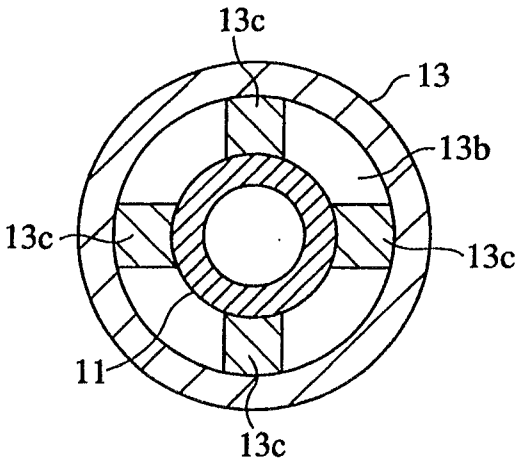
FIG. 2 is a cross-sectional view taken along a line II—II of FIG. 1.

Referring to the drawings, certain illustrative embodiments of the present invention will be explained in detail.

Figure 1:
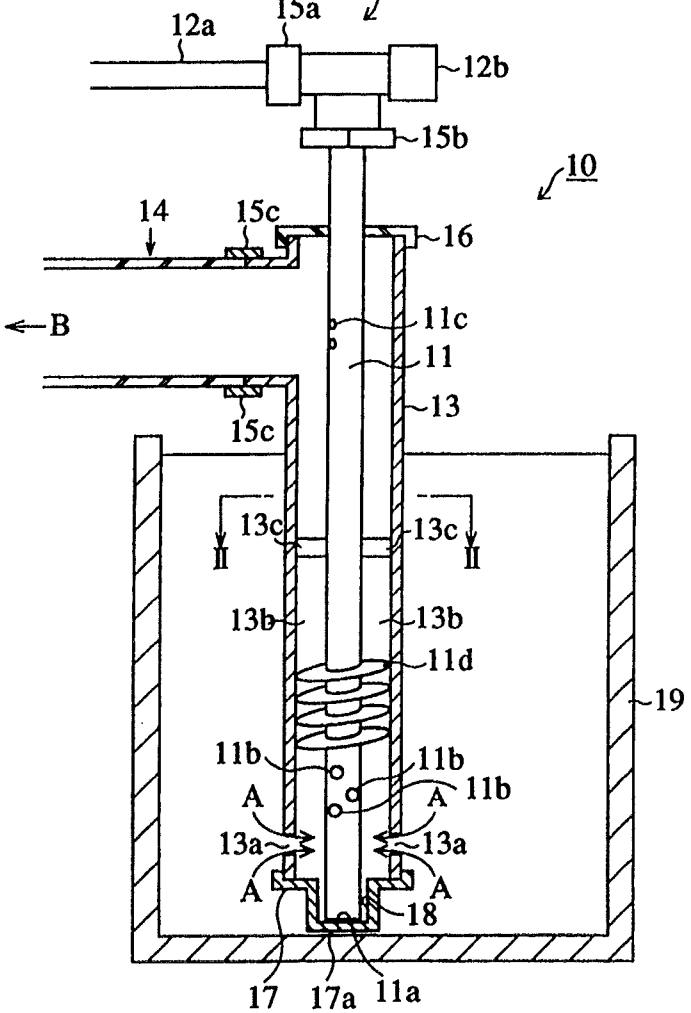
FIG. 1 is a schematic partial cross-sectional view showing an embodiment of a highly viscous fluid suction and dilution device according to the present invention.

First referring to FIG. 1, a suction and dilution device 10 for a highly viscous fluid includes an outer tubular member 13 and an inner tubular member 11 inserted into the outer tubular member 13 for forming a dual tube to define a passageway **13*b* extending along the length of the outer tubular member 13. The outer tubular member 13 sucks the highly viscous fluid and mixes it with a diluting liquid supplied through the inner tubular member 11**.

The inner tubular member 11 has a length longer than the outer tubular member 13 so that the tubular member 11 is axially extended beyond the upper and lower ends of the outer tubular member 13. A diluting liquid flow controller 12 is provided at the upper end extremity of the inner tubular member 11. The diluting liquid flow controller 12 is comprised of a hose **12*a* connected to pressurizing pump, not shown, for supplying the diluting liquid, and a hand-valve 12*b* for controlling the flow of the dilution liquid coupled by a joint member 15*a*, such as a coupler. The controller 12 is connected to the upper end extremity of the inner tubular member 11 by a joint member 15*b*. A diluting liquid ejection port 11*a* is provided at the lower end extremity of the inner tubular member 11 for ejecting the diluting liquid transported under pressure from the controller 12. The lower wall portion of the inner tubular member 11 and the upper wall portion thereof in register with a fluid suction hose 14 as later explained are formed with six through-holes 11*b* and two through-holes 11*c*, respectively for ejecting the diluting liquid into the inside of the outer tubular member 13**.

The outer tubular member 13 has seven inlet ports **13*a* at its lower portion for sucking the highly viscous fluid. The outer tubular member 13 is connected at its upper portion via a joint member 15*c*, such as a coupler, to the fluid suction hose 14** which is in turn connected to a rotary pump, not shown, for sucking the diluted viscous fluid.

The inner tubular member 11 for supplying the diluting liquid is connected and secured to an upper end of the outer tubular member 13 via a connector 16 such as a threaded sleeve for piping connection, and a spacer **13*c* for securing the inner tubular member 11 in place (see FIG. 2), so as to provide a dual tube structure. At the lower end of the inner tubular member 11 protruded from the outer tubular member 13 and at the lower end extremity of the outer tubular member 13, a lid member 17 having its mid portion protruded downwards for defining an inner recess 17*a* is secured to the outer tubular member 13 for sealing the tube end. Since the recess 17*a* of the lid member 17 has an inner diameter larger than the outer diameter of the inner tubular member 11, and is positioned for sheathing the protruded portion of the inner tubular member 11, there is defined a gap 18 between the recess 17*a* and the protruded portion of the inner tubular member 11. The gap 18 serves as a passageway interconnecting the inner tubular member 11 and the outer tubular member 13. The lid member 17 upwardly deflects the diluting liquid flowing down within the inner tubular member 11 towards the suction ports 13***a* for the highly viscous fluid. Thus, the diluting liquid flowing down in the inner tubular member 11 is ejected via the ejection port 11*a* to impinge on the inner bottom surface of the recess 17*a* so as to be diverted upwards via the gap 18 towards the suction ports 13*a* for the highly viscous fluid.

When the above-described suction and dilution device 10 for the highly viscous fluid is in use, the device 10 is placed so that the suction ports 13*a* for the highly viscous fluid are immersed in a can 19 in which the highly viscous fluid is contained as shown in FIG. 1. The pressurizing pump, not shown, connected to the diluting liquid flow controller 12, and the rotary pump, also not shown, connected to the fluid suction hose 14, are started for sucking the highly viscous fluid via the suction ports 13*a* into the inside of the outer tubular member 13 for fluid suction, as shown by arrows A, while supplying the diluting liquid into the inside of the inner tubular member 11 for ejection the diluting liquid via the ejection port 11*a*, through-holes 11*b* into the passageway 13*b* inside the outer tubular member 13. The flow rate of the diluting liquid may be adjusted at this time by the hand-valve 12*b*.

The flow of the diluting liquid and the highly viscous fluid is explained in further detail. The diluting liquid pressurized and supplied from the diluting liquid flow controller 12 is caused to flow through the inside of the inner tubular member 11 and ejected via the ejection port 11*a* for impinging on the inner bottom surface of the recess 17*a* of the lid member 17. The diluting liquid thus impinging on the bottom surface of the recess 17*a* is moved into the inside of the outer tubular member 13 via the gap 18. On the other hand, the highly viscous fluid is sucked by the rotary pump via the suction ports 13*a* so as to be mixed and diluted with the diluting liquid which is supplied thereto via the gap 18.

Although the diluted fluid may be directly sucked and transported towards the fluid suction hose 14, since it is desirable to achieve more uniform dilution and to lower the viscosity of the sucked highly viscous fluid reliably, the plural through-holes 11*b* are formed in the inner tubular member 11 above the suction ports 13*a* at different heights with respect to the axial direction of the tubular members 11 and 13. The diluting liquid ejected via these through-holes 11*b* further dilutes the fluid diluted in the region of the suction port 13*a*, while uniformly mixing the fluid flow in turbulence. Thus, it is preferred to provide the plural through-holes 11*b* above the suction port 13*a* in order to achieve uniform mixing. To achieve further uniform mixing, spiral-shaped vane members 11*d* may be provided, in addition to the through-holes 11*b*, in order to produce an eddy-like agitation and suction of the fluid in at least a portion of the passageway 13*b* within the outer tubular member 13.

The fluid thus uniformly mixed together and diluted is transported via the fluid suction hose 14 to outside, as indicated by an arrow B in FIG. 1. The through-holes 11*c*, formed in the inner tubular member 11 play the role of ejecting the diluting liquid into the inside of the outer tubular member 13 and into the fluid suction hose 14 in order to prevent the rotary pump from sucking air and running in idleness when the fluid is not lowered sufficiently in viscosity and hence suction is not effected smoothly.

The arraying positions of the through-holes 11*b*, 11*c* and the suction ports 13*a* for the highly viscous fluid in the present embodiment, as well as the region of communication of the ejection ports 11*a* with the outer tubular member 13, may be suitably modified from those described above, provided that a series of diluting and mixing operations are designed to occur entirely within the passasgeway 13*b*.

Besides, the inner tubular member 11, the outer tubular member 13, the suction port 13*a* for the highly viscous liquid and the through-holes 11*b* and 11*c* may have diameters and numbers suitably selected depending on design parameters, such as the viscosity of the highly viscous fluid or the pressures of the pressurizing pump or the rotary pump.

Figure 4:
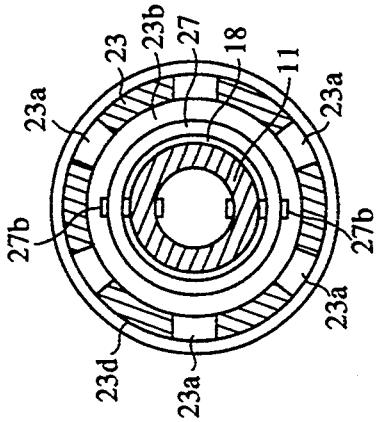
FIG. 4 is a cross-sectional view taken along a line IV—IV of FIG. 3.
Figure 3:
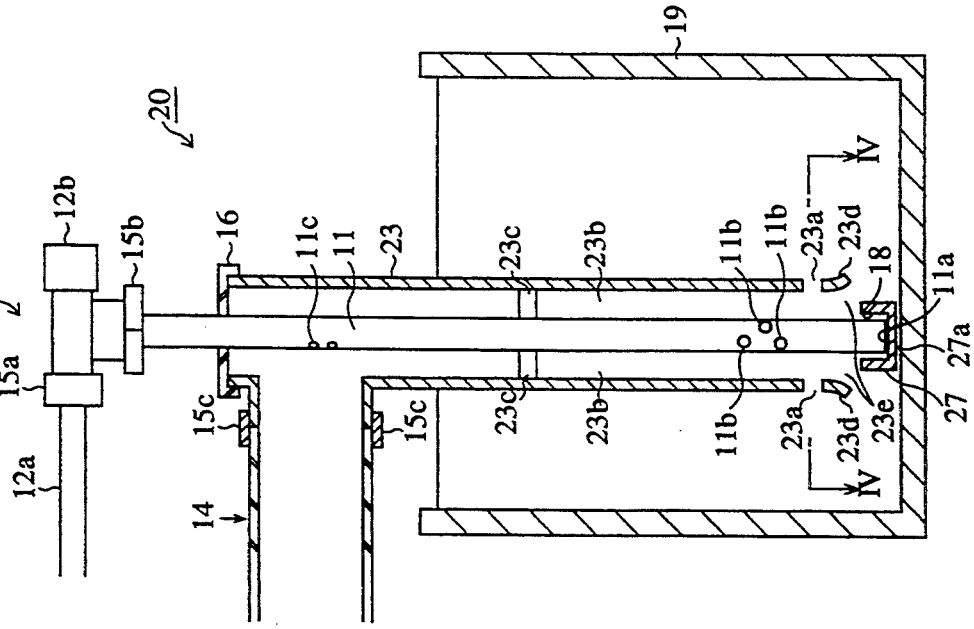
FIG. 3 is a schematic partial cross-sectional view showing a highly viscous fluid suction and dilution device according to another embodiment of the present invention.

Referring to FIGS. 3 and 4, the suction and dilution device according to a modification of the present invention is now explained.

A suction and dilution device 20, shown in FIG. 3, includes an outer tubular member 23 as later explained, and a lid member 27, in place of the outer tubular member 13 and the lid member 17 of the above-described suction and dilution device 10, respectively. The components which are similar to those described in the previous embodiment as indicated by the same reference numerals and the corresponding description are omitted for avoiding redundancy.

Similarly to the above-mentioned outer tubular member 13, the outer tubular member 23 shown in FIG. 3 has seven equally spaced apart ports 23*a* for sucking the highly viscous fluid on its lower wall portion. A fluid suction hose 14, fitted with a rotary pump for sucking the diluted highly viscous fluid, not shown, is connected to the upper portion of the outer tubular member 23 by a joint member 15*c*, such as a coupler. The outer tubular member 23 also has its lower end extremity flared to form a tapered portion 23*d* serving as a second suction ports 23*e* for sucking the highly viscous fluid. An inner tubular member 11 is connected and secured to the outer tubular member 23 to form a dual tube structure by a connecting member 16, such as a threaded sleeve for connecting the piping, and a spacer 23*c* formed between the inner tubular member 11 and the outer tubular member 23.

A lid member 27 is profiled similarly to the recess 17*a* of the lid member 17, and has an inner diameter larger than the outer diameter of the inner tubular member 11 and an outer diameter smaller than the inner diameter of the outer tubular member 23. The lid member 27 is secured by bolts 27*b* to an end part of the inner tubular member 11 for defining a gap 18, as shown in FIG. 4. Similarly to the lid member 17, the lid member 27 is used for changing the proceeding direction of the diluting liquid for directing the liquid towards the second suction ports 23*e* for sucking the highly viscous fluid. Thus, the diluting liquid supplied from the diluting liquid flow controller 12 under the pressurized state is caused to flow down through the inside of the inner tubular member 11 and ejected via the ejection port 11*a* to impinge on the bottom surface of the recess 27*a*. The diluting liquid is then guided by the gap 18 so that it is caused to flow upwards towards the suction ports 23*e* for sucking the highly viscous fluid, the lower end of which is flared to form the tapered portion 23*d*. The highly viscous fluid is mixed and diluted with the diluting liquid in the vicinity of the suction ports 23*e* to form a diluted fluid which is sucked by the rotary pump. The highly viscous fluid sucked through the suction ports 23*e* and the diluting liquid ejected via the through-holes 11*b* of the inner tubular member 11 are further mixed and diluted so as to be sucked by the rotary pump, not shown.

In this manner, with the present suction device 20 for the highly viscous fluid, the highly viscous fluid sucked through the suction ports 23*a*, 23*e* is mixed and diluted with the diluting liquid ejected via the gap 18 and the through-holes 11*b* in the vicinity of the tapered portion 23*d* of the outer tubular member 23.

Besides, the inner tubular member 11, the outer tubular member 23, the suction ports 23*a*, 23*e* and the through-holes 11*b* and 11*c* of the suction device 20, may have diameters and numbers suitably selected depending on design parameters, such as the viscosity of the highly viscous fluid or the pressures of the pressurizing pump or the rotary pump, as in the case of the above-mentioned suction device 10 for the highly viscous fluid. For processing the concentrated fruit juice having a viscosity of approximately 100,000 cp as the highly viscous fluid, it is preferred to set the pressure of the pressurizing pump to 1.7 to 2.6 kg/cm$^2$, the amount of supply of the diluting liquid, herein water, to 48 to 65 liters/minute, the pressure of the rotary pump to 0.3 to 0.5 kg/cm$^2$ and the amount of suction of the fluid to 130 to 360 liters/minute.

Using the suction and dilution device 20 for the highly viscous fluid of the embodiment herein, 2,200 kg of Valencia orange juice manufactured in the United States of America by Citrusworld Inc. with the sixfold concentration and the Brix degree of 65.6, and corresponding to full content of 10 drum cans, were diluted under the above-mentioned preferred conditions. The diluted fruit juice of Brix degree of 47.0 could be produced. On the other hand, 2,200 kg of Valencia orange juice manufactured by Cargill Inc. with the sixfold concentration and the Brix degree of 64.2, and corresponding to full content of 10 drum cans, were diluted, and the diluted fruit juice with the Brix degree of 36.8 could be produced. The operating time was 20 minutes for one workman. The same concentrated fruit juices were processed by manual operation of three workmen with addition of water, agitation and suction. The fruit juices could be diluted to substantially the same concentration in 60 minutes.

The highly viscous fluid which can be diluted using the suction and dilution device of the present invention may be enumerated by various saccharide syrups, such as honey or high fructose corn syrup, and condensed milk, in addition to the concentrated fruit juice. On the other hand, the diluting liquid may be any suitable liquids, in addition to water, depending on the type of the highly viscous fluids.

Figure 5:
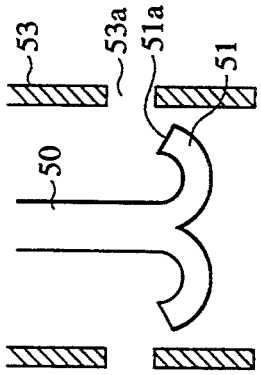
FIG. 5 is a schematic partial cross-sectional view showing a further embodiment of the bottom portion of a fluid suction and dilution device according to the invention.

The suction and dilution device for the highly viscous fluid according to the present invention is not limited to the above-mentioned devices 10 and 20. Above all, as shown in FIG. 5, the diluting liquid may be passed through one or more U-shaped tubes 51 provided at the lower end of a diluting liquid supplying inner tubular member 50 and ejection ports 51*a* of the U-shaped tubes 51 may be disposed in the vicinity of suction ports 53*a* of a fluid suction outer tubular member 53.

Although the present invention has been described with reference to the preferred embodiments, it should be understood that various modifications and variations can be easily made by those skilled in the art without departing from the spirit of the invention. Accordingly, the foregoing disclosure should be interpreted as illustrative only and is not to be interpreted in a limiting sense. The present invention is limited only by the scope of the following claims.

What is claimed is:

1. A device for sucking and diluting a highly viscous fluid comprising:

an outer tubular member having a suction port for sucking the highly viscous fluid therein, said outer tubular member being connected to a suction source, an inner tubular member arranged within said outer tubular member and adapted for passing a diluting liquid for diluting the highly viscous fluid therethrough, said inner tubular member having an ejection port for ejecting the diluting liquid into a space delimited between said outer tubular member and said inner tubular member, and mixing means for uniformly mixing said highly viscous fluid and said diluting liquid in said space delimited between said outer tubular member and said inner tubular member.

2. The device as claimed in claim 1 wherein said mixing means comprises:

a lower end opening formed at a lower end of said inner tubular member for ejecting the diluting liquid, and a cap member for sealing a lower end of said outer tubular member so that the diluting liquid ejected via the lower end opening impinges on the cap member and is thereby deflected in its flowing direction so as to be ejected via a gap defined between the cap member and the lower end of the inner tubular member.

3. The device as claimed in claim 2 wherein said lower end of said outer tubular member is flared to form a tapered lower end for defining an additional suction port between the tapered lower end and said cap member, the diluting liquid further impinging on said tapered lower end for being thereby agitated.

4. The device as claimed in claim 1 wherein said mixing means comprises spiral-shaped vanes arranged in said space defined between said outer tubular member and said inner tubular member for spirally agitating said diluting liquid and said highly viscous fluid.

5. The device as claimed in claim 1 wherein said mixing means comprises a U-shaped tube formed at the lower end of said inner tubular member for upwardly deflecting said diluting liquid and ejecting the deflected diluting liquid in the vicinity of said suction port of said outer tubular member.

6. The device as claimed in claim 1 wherein a plurality of said ejection ports are formed at different height positions above said suction port to permit sufficient mixing of said highly viscous fluid and said diluting liquid.

7. The device as claimed in claim 1 further comprising valve means connected to said inner tubular member for adjusting a flow rate of said diluting liquid.

8. The device as claimed in claim 1 further comprising a connecting hose connected to said suction source and to said outer tubular member, said inner tubular member having an additional ejection port in a region of connection of said connecting hose to said outer tubular member for mixing said highly viscous fluid and said diluting liquid in said region.

* * * * *